United States Patent [19]

Sanders, Jr. et al.

[11] Patent Number: 4,812,183

[45] Date of Patent: Mar. 14, 1989

[54] COATED SHEET STOCK

[75] Inventors: Robert E. Sanders, Jr., New Kensington, Pa.; Henry W. Kaanta, Newburgh, Ind.; John K. McBride, New Kensington, Pa.; Milton W. Milner, Newburgh, Ind.; Terry A. Perigo, Boonville, Ind.; Samuel L. Shelby, Newburgh, Ind.

[73] Assignee: Aluminum Company of America, Pittsburgh, Pa.

[21] Appl. No.: 814,461

[22] Filed: Dec. 30, 1985

[51] Int. Cl.[4] ..... C22F 1/047

[52] U.S. Cl. ..... 148/439; 148/11.5 A; 420/533

[58] Field of Search ..... 148/2, 11.5 A, 417, 148/439; 420/533

[56] References Cited

U.S. PATENT DOCUMENTS

| | | | |
|---|---|---|---|
| 4,282,044 | 8/1981 | Robertson et al. | 148/11.5 A |
| 4,284,437 | 8/1981 | Baba et al. | 148/11.5 A |
| 4,582,541 | 4/1986 | Dean et al. | 148/11.5 A |

OTHER PUBLICATIONS

"Registration Record of Aluminum Association Designations and Chemical Composition Limits for Wrought Aluminum and Wrought Aluminum Alloys", Aluminum Association, Inc., Washington, D.C., Jul. 1981.

*Primary Examiner*—L. Dewayne Rutledge
*Assistant Examiner*—Robert L. McDowell
*Attorney, Agent, or Firm*—Andrew Alexander

[57] ABSTRACT

Disclosed is a method of making an improved aluminum alloy coated sheet stock useful for fabricating into easy-open ends for beverage containers. The method comprises the steps of providing a body of an aluminum base alloy consisting essentially of, by weight, 4.0 to 5.5% Mg, 0.2 to 0.7% Mn, 0.05 to 0.40% Cu, the balance being aluminum, incidental elements and impurities and rolling the body to produce an aluminum sheet stock. The sheet stock is subjected to a structure refining operation to precipitate finally divided magnesium containing constituent and thereafter the sheet stock is coated with an organic coating material and cured at a temperature sufficiently low and for a period of time to avoid dissolving the precipitated constituent to provide coated sheet stock having improved levels of tensile strength and high levels of formability.

14 Claims, 2 Drawing Sheets

2 hours 20 minutes 60 seconds

COATED SHEET STOCK

BACKGROUND OF THE INVENTION

This invention relates to improved aluminum alloy sheet stock, and more particularly, it relates to a method of providing coated aluminum sheet stock having improved strength and high levels of formability.

Aluminum alloys such as AA5182 have found widespread use as easy-open ends for containers. The sheet from which an end is made must have sufficient formability to make an integral rivet and a fracture-free score as well as sufficient strength to resist buckling caused by internal pressurization of the can. When it is desired to downgauge end stock, such as AA5182, many different problems arise because of constraints already imposed upon the sheet. For example, to downgage end stock sheet requires the use of even higher strength alloys. However, typically with higher strength alloys, formability decreases. Thus, it will be seen that it is highly desirable to provide higher strength alloys with no loss in formability in order that the integrity of the integral rivet and score line on the can end is not compromised.

Examples of compositions suitable for end stock are provided in U.S. Pat. Nos. 3,560,269 and 3,502,448, which are typical of work-hardened 5000 series alloys. Such alloys are known to suffer from progressive room or elevated temperature age softening (reduction in strength) with time. In the past, such alloys have been subjected to thermal softening treatments to lower the mechanical properties to a level where they will be stable over a long period of time. This treatment provides for much the same level of formability regardless of the time between fabricating the sheet and forming the can ends and is referred to as stabilization. The stabilizing process is different from partial annealing which is used to achieve specific strength and ductility properties through thermal softening of the sheet.

To make thinner sheet suitable for beverage can ends, there is a great need for an improved process which will provide for improved strength levels while maintaining a high level of formability and which process will not lower mechanical properties, such as results from stabilization or annealing.

SUMMARY OF THE INVENTION

An object of the invention is to provide an improved aluminum alloy sheet stock.

Another object of the invention is to provide a method of providing an improved aluminum alloy sheet stock.

Yet another object of the invention is to provide a method for production of improved coated aluminum sheet product.

A further object of the invention is to provide a method of producing coated aluminum alloy sheet stock having higher levels of strength and formability.

And yet a further object of this invention is to provide improved coated aluminum sheet stock having improved levels of strength and formability resulting from thermal treatments in a coil coating operation.

In accordance with these objects, there is disclosed a method of making an improved aluminum alloy coated sheet stock useful for fabricating into easy-open ends for beverage containers. The method comprises the steps of providing a body of an aluminum base alloy comprising, by weight, 4.0 to 5.5% Mg, 0.2 to 0.7% Mn, 0.05 to 0.40% Cu, the balance being aluminum, incidental elements and impurities and rolling the body to produce an aluminum sheet stock. The strain-hardened sheet stock is subjected to a structure refining operation at a temperature in the range of 200° to 400° F. for a period of 0.5 to 8 hours to precipitate finally divided magnesium containing constituent and thereafter the sheet stock is coated with an organic coating material and cured at a temperature sufficiently low and for a period of time to avoid dissolving the precipitated constituent to provide coated sheet stock having improved levels of tensile strength and high levels of formability.

DETAILED DESCRIPTION OF THE PREFERRED EMBODIMENTS

Figure 1:
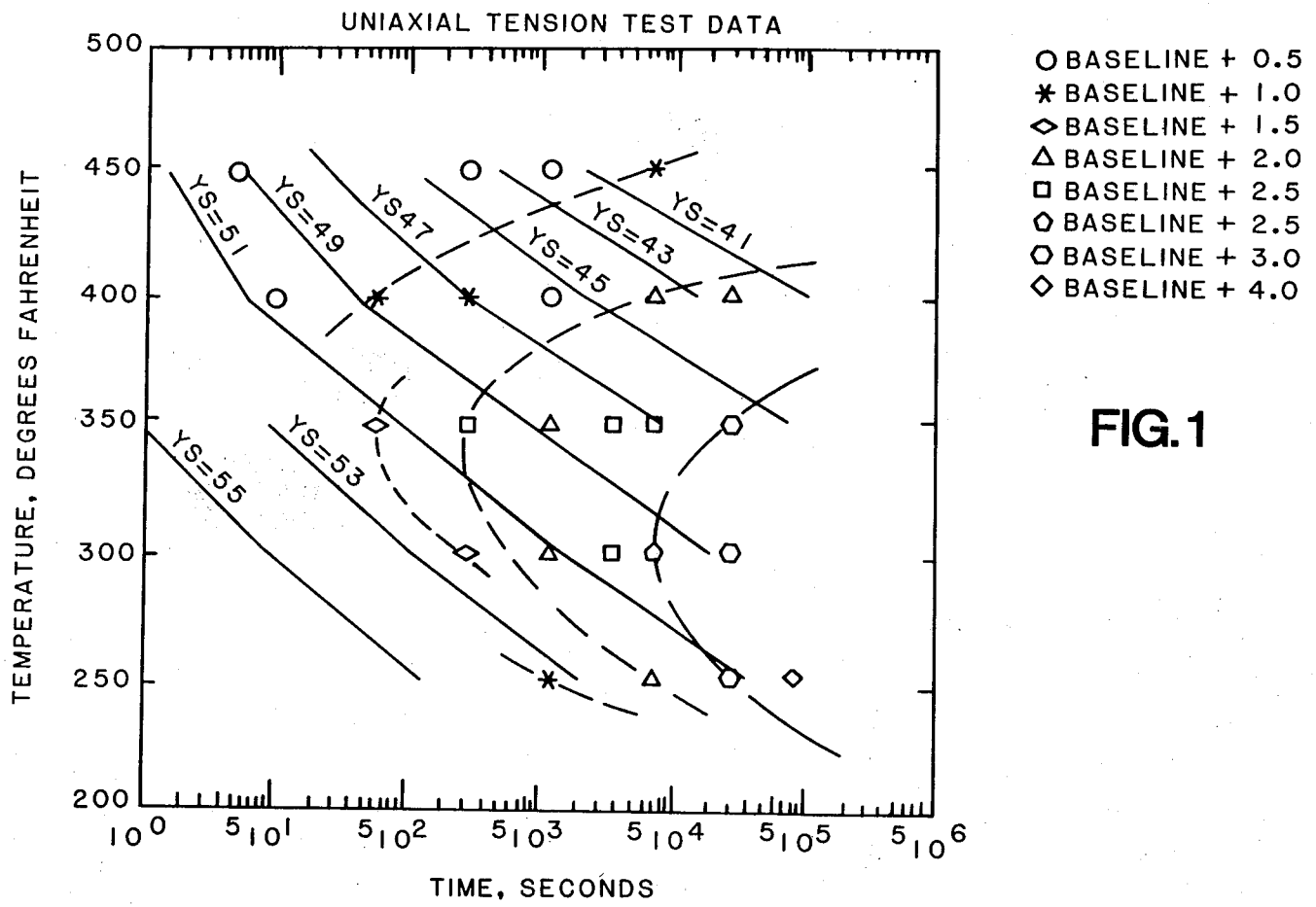
FIG. 1 is a graph showing curing time, temperatures and the resulting change in strength of coated sheet stock.

The alloy of the present invention can contain 4.0 to 5.8 wt. % Mg, 0.2 to 0.9 wt. % Mn, 0.02 to 0.40 wt. % Cu, the balance being aluminum and incidental elements and impurities. The maximum amounts of impurities in the alloy are 0.5 wt. % Fe, 0.3 wt. % Si, 0.1 wt. % Ti, 0.2 wt. % Cr, all other impurities being limited to 0.05 wt. % each, and a total of 0.15 wt. %. In addition, Fe plus Si should not exceed 0.45 wt. % max. Additionally, Mg plus Cu should be greater than 5.0 wt. %. A preferred alloy in accordance with the present invention can contain 4.70 to 5.5 wt. % Mg, 0.40 to 0.70 wt. % Mn, 0.17 to 0.25 wt. % Cu, with the max. for Si being 0.18 wt. % and Fe being 0.36 wt. %. An alloy composition for high strength would contain about above 5.0 to 5.8 wt. % Mg, 0.3 to 0.6 wt. % Mn, above 0.2 to 0.29 Cu, with Fe and Si as above. A typical alloy composition would contain about 5.2 wt. % Mg, 0.83 wt. % Mn, 0.21 wt. % Cu, 0.26 wt. % Fe and 0.12 wt. % Si. When it is desired to minimize formability, it will be understood that levels of alloying elements should be lower than that required for high strength. For example, Mg and Cu should have a minimum of 5.0 wt. % and max. of 6.0 wt. % will provide improved strength levels and yet retain high levels of formability when processed in accordance with the invention.

As well as providing the alloy product with controlled amounts of alloying elements as described hereinabove, it is preferred that the alloy be prepared according to specific method steps in order to provide the most desirable characteristics of both strength and formability. Thus, the alloy as described herein can be provided as an ingot or billet for fabrication into a suitable wrought product by casting techniques currently employed in the art for cast products with continuous casting being preferred. Prior to the principal working operation, the alloy stock is preferably subjected to homogenization. The homogenization is preferably carried out at a metal temperature in the range of 900° F. to 1040° F. for a period of time of at least 1 hour to dissolve soluble elements and to homogenize the internal structure of the metal. A preferred time period is about 4 hours or more in the homogenization temperature range. Normally, the heatup and homogenizing treatment does not have to extend for more than 8 hours, however, longer times are not normally detrimental. 4 to 6 hours at the homogenization temperature has been found to be quite suitable. A typical homogenization temperature is 960° F. and a typical time at this temperature is about 6 hours. After homogenization, the ingot is hot worked or hot rolled to provide an intermediate gauge. Hot rolling is performed wherein the starting temperature for rolling is in the range of 700° to 975° F. When the use of the alloy is for beverage cans, such as end stock, the hot rolling is performed to provide an intermediate product having a thickness of about 0.190 inch to 0.130 inch. Thereafter, the intermediate product may then be annealed by heating to about a temperature in the range of 500° to 700° F. for a period of time sufficient to recrystallize the internal structure. Next, this material is cold rolled to provide a sheet ranging in thickness from about 0.008 to 0.015 inch.

Prior to coating the sheet with an organic coating, it is first subjected to a thermal step for purposes of providing the sheet with a refined structure. It is this refined structure which is important to the properties of the final product and which must be carefully controlled along with the coating and curing step to ensure that the desirable properties are retained. Thus, prior to coating, the sheet stock is subjected to a thermal treatment for structure refining purposes to effect precipitation of Mg in the alloy from solid solution in the form of an Mg2Al3 phase, the thermal treatment being applied at a temperature in the range of 250° to 400° F. for a period of 1 to 24 hours. Times and temperatures which may be used to produce maximum precipitation of the Mg2Al3 phase are shown in FIG. 1. The C-curves in FIG. 1 represent the relative densities of precipitates and show the changes in mechanical properties with time and temperature obtained by thermally treating 5182-H19 (strain-hardened) sheet. The straight lines are for constant yield strength conditions produced by various thermal treatments. The curved lines represent similar levels of Mg2Al3 precipitation produced by the thermal treatments. Thus, it is possible to reach identical strength levels by different thermal treatments and have differing amounts of Mg2Al3 precipitation. The preferred structure produced by the structure refining treatment is one in which both the strength level and amount of Mg2Al3 (i.e., minimum Mg in solution) is maximized.

Figure 2C:
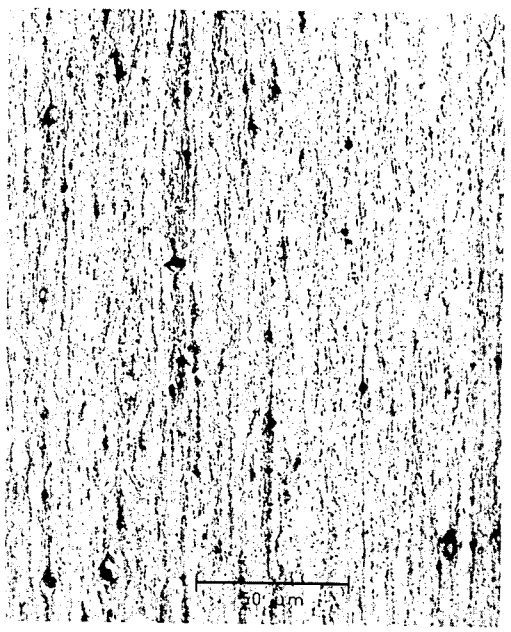
FIG. 2(*a*)–(*c*) is a series of micrographs which include microstructures in accordance with the invention.
Figure 2B:
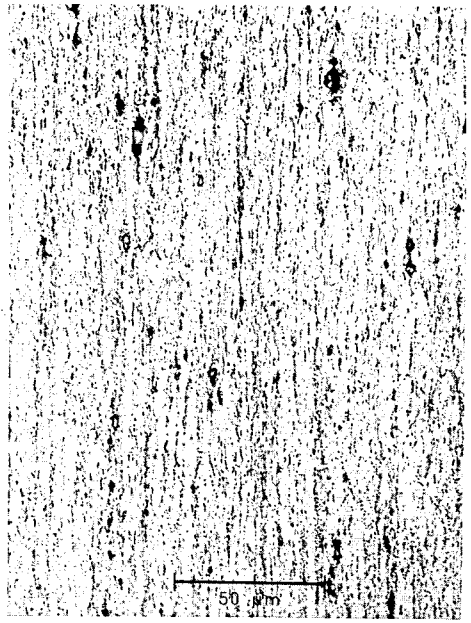
Figure 2A:
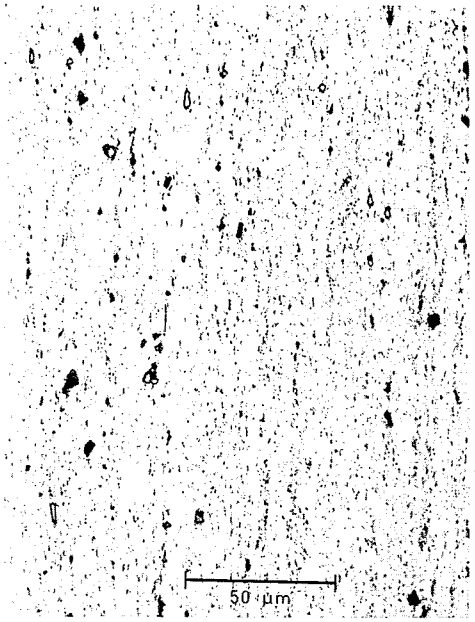

FIG. 2(*a*)–(*c*) is a series of optical photomicrographs illustrating progressive increase in density of the precipitate at 350° F. for aluminum alloy 5182 with the micrograph designated as (c) showing an example of microstructure in accordance with the invention which can be obtained by a thermal treatment at 350° F. for 2 hours.

After structure refining, the sheet stock is then cleaned and coated with an organic coating material. The coating can be applied directly by passing the sheet stock through a bath, or it may be electrolytically deposited thereon, such as disclosed in U.S. Pat. No. 3,962,060 incorporated herein by reference. Thereafter, the organic coating is cured.

In applying the organic coating to the end stock, curing of the coating requires temperatures of about 425° to 500° F. for short periods of time which typically are not longer than 2 to 3 minutes and often are on the order of about 1 minute. Curing of the coating can have the effect of reducing the strength of the initially work hardened material and can increase elongation when compared to uncoated material. However, the thermal cure does not produce coated sheet with the improved strength and high levels of formability which are so necessary to permit the use of thinner gauge end stock without compromizing the integrity of the can end. Accordingly, it is necessary to create the correct microstructure in the coated end stock which will allow it to respond properly to deformation during forming of the can end. Thus, structure refining is achieved, in accordance with the invention, by subjecting the sheet product to above-noted thermal treatments prior to applying the organic coating.

The temperature for curing of the organic coating must be carefully controlled. That is, too high curing temperatures can operate to adversely affect structure refining obtained earlier, and thus such treatments must be avoided to ensure that the formability levels are retained. Thus, accordingly, maximum times at the higher curing temperature should not exceed 20 seconds in some cases. At the lower temperature of the range, the curing time can be extended to 20 minutes. Preferably, curing temperatures are maintained below 450° F. for a period in the range of 5 seconds to 20 minutes. Thus, it will be seen that these curing temperatures are important so as to keep magnesium out of solid solution and to prevent its dissolving with the resulting loss of the precipitate constituents. It should be understood that it is the combination of thermal refining, coating and curing parameters along with the alloy composition which unite to provide this unique coated end stock having improved strength levels without loss of formability.

An alloy containing 4.32 Mg, 0.4 Mn, 0.04 Cu, 0.25 Fe, 0.12 Si, was cast and hot rolled to an intermediate gauge, annealed and cold rolled to a final gauge of 0.013 inch and subjected to thermal treatments as listed in Table 1. The corresponding properties show the significance of the invention. For example, treatment A, which is typical of curing an organic coating on coil, produces high strengths but low levels of formability. However, treatments B and C maintain high strength levels and provide high levels of formability.

Two alloys referred to as alloys I and II were cast and rolled as above. The composition for alloy I is 4.74 Mg, 0.35 Mn, 0.20 Cu, 0.12 Si and 0.24 Fe; and the composition for alloy II is 5.45 Mg, 0.64 Mn, 0.02 Cu, 0.11 Si and 0.19 Fe.

The properties for both alloys in the as-rolled condition are shown in Table II. Sheet samples of these alloys were then treated in the laboratory by curing for 30 seconds at 450° F, and the properties are shown in Table III. Sheet samples of these alloys were structure refined and alloy I was treated for 24 hours at 300° F., and alloy II was treated for 2 hours at 300° F. prior to subjecting both alloys to a typical organic coating curing treatment of 30 seconds at 450° F. The properties are shown in Table IV. It will be noted that both strengths and levels of formability are higher than that shown in Table III. These differences in properties are significant in that they permit marked reductions in the thickness or gauge of can end sheet stock without adversely affecting the integrity of the can end in use. If curing temperatures are used above that set forth herein, it results in a loss of both strength and refined conditions of the microstructure which translates to a loss of formability.

TABLE I

| Treatment | YS | $\epsilon_c$ | $\epsilon_f-\epsilon_i$** | UTS − YS |
|---|---|---|---|---|
| (A) 15 sec/450° F. | 49.6 | .0065 | .003 | 7.5 |

TABLE I-continued

| Treatment | YS | $\epsilon_c$ | $\epsilon_f$-$\epsilon_i$** | UTS − YS |
|---|---|---|---|---|
| (B) 1 hr/350° F. | 49.1 | .0138 | .010 | 8.5 |
| (C) 24 hrs/300° F. | 48.8 | .0182 | .012 | 9.8 |

*$\epsilon_c$ = strain at which serrated flow begins in tensile test.
**$\epsilon_f$-$\epsilon_i$ = post-instability strain in a biaxial bulge test.

TABLE II

| | Properties in the As-Rolled Condition | | |
|---|---|---|---|
| | YS | UTS | Elong. |
| Alloy I | 60.2 | 64.4 | 5.0 |
| Alloy II | 63.9 | 67.6 | 4.5 |

TABLE III

| | Organic Coating-Curing Treatment - 450° F. for 30 Sec. | | |
|---|---|---|---|
| | YS | UTS | Elong. |
| Alloy I | 49.8 | 57.4 | 8.0 |
| Alloy II | 51.8 | 60.0 | 7.5 |

TABLE IV

| | Structure Refining Operation (hrs. 300° F.) Followed by Organic Coating-Curing Treatment - 450° F. for 30 Sec. | | | |
|---|---|---|---|---|
| | Structure Refining Treatment | YS | UTS | Elong. |
| Alloy I | 24 hr/300° F. | 52.0 | 60.1 | 9.0 |
| Alloy II | 2 hr/300° F. | 53.6 | 63.4 | 8.5 |

Aluminum alloy sheet stock prepared in accordance with the present invention has the advantage that it can have 7 to 10% improvement strength compared to conventional 5182 end stock while maintaining its formability. Thus, thinner ends can be fabricated without adversely affecting the strength of the containers.

While the invention has been described in terms of preferred embodiments, the claims appended hereto are intended to encompass all embodiments which fall within the spirit of the invention.

What is claimed is:

1. A method of making an improved aluminum alloy sheet stock useful for fabricating into easy-open ends for beverage containers comprising the steps of:

(a) providing a body of an aluminum base alloy consisting essentially of, by weight, 4.0 to 5.8% Mg, 0.2 to 0.9% Mn, 0.17 to 0.40% Cu, the balance being aluminum, incidental elements and impurities;

(b) rolling said body to produce an aluminum sheet stock;

(c) subjecting said sheet stock to a structure refining operation at a temperature in the range of 250° to 400° F. to precipitate finally divided magnesium containing constituent;

(d) coating said sheet stock with an organic coating material; and (e) curing said coating at a temperature sufficiently low and for a period of time to avoid dissolving said precipitated constituent to provide said sheet stock having improved levels of tensile strength and high levels of formability.

2. The method in accordance with claim 1 wherein the body consists essentially of, by weight, 4.70 to 5.50 Mg, 0.40 to 0.70 Mn and 0.17 to 0.25 Cu.

3. The method in accordance with claim 1 wherein the structure refining operation is carried out for a period of from 1 to 24 hours.

4. The method in accordance with claim 1 wherein said body is hot rolled starting at a temperature in the range of 700° to 975° F.

5. The method in accordance with claim 4 wherein said body is hot rolled to a thickness of 0.190 to 0.130 inch.

6. The method in accordance with claim 5 wherein said sheet is annealed at a temperature in the range of 500° to 700° F.

7. The method in accordance with claim 6 wherein said sheet product is cold rolled to a thickness in the range of 0.008 to 0.015 inch.

8. The method in accordance with claim 1 wherein said curing is carried out at a temperature in the range of 430° F. to 500° F.

9. The method in accordance with claim 1 wherein said curing time is in the range of 5 seconds to 20 minutes.

10. The method in accordance with claim 1 wherein the curing temperature is not greater than 450° F.

11. A method of making an improved aluminum alloy sheet stock useful for fabricating into easy-open ends for beverage containers comprising the steps of:

(a) providing a body of an aluminum base alloy consisting essentially of, by weight, 4.70 to 5.5 Mg, 0.32 to 0.43 Mn and 0.17 to 0.25 Cu, the balance being aluminum, incidental elements and impurities;

(b) hot rolling said body starting at a temperature in the range of 700° to 975° F. to a thickness of 0.190 to 0.130 inch, annealing said hot rolled product at a temperature of 500° to 700° F. and thereafter cold rolling said annealed product to a thickness in the range of 0.008 to 0.015 inch;

(c) subjecting said sheet stock to a structure refining operation at a temperature in the range of 250° to 400° F. for a period of from 1 to 24 hours to precipitate finally divided magnesium containing constituent;

(d) coating said sheet stock with an organic coating material; and (e) curing said coating at a temperature greater than 430° F. not greater than 450° F. for a periof of less than 3 minutes to avoid dissolving said precipitated constituent to provide said sheet stock having improved levels of tensile strength and high levels of formability.

12. An improved aluminum alloy coated sheet stock for fabricating into easy open ends for beverage containers resulting from any one of claims 1 through 11.

13. An improved aluminum alloy coated sheet stock for fabricating into easy open ends for beverage containers resulting from the steps of:

(a) providing a body of an aluminum base alloy consisting essentially of, by weight, 4.0 to 5.5% Mg, 0.2 to 0.7% Mn, 0.17 to 0.40% Cu, the balance being aluminum, incidental elements and impurities;

(b) hot rolling said body starting at a temperature in the range of 700° to 975° F. to a thickness of 0.190 to 0.130 inch, annealing said hot rolled product at a temperature of 500° to 700° F. and thereafter cold rolling said annealed product to a thickness in the range of 0.008 to 0.015 inch;

(c) subjecting said sheet stock to a structure refining operation at a temperature in the range of 250° to 400° F. for a period of from 1 to 24 hours to precipitate finally divided magnesium containing constituent;

(d) coating said sheet stock with an organic coating material; and (e) curing said coating at a temperature in the range of 425° to 500° F. for a period of time in the range of 5 seconds to 20 minutes to avoid dissolving said precipitated constituent to provide said sheet stock having improved levels of tensile strength and high levels of formability.

14. The sheet stock in accordance with claim 13 wherein the Mg plus Cu is 5.0 wt. % or greater.

* * * * *